US006190588B1

(12) United States Patent
Schmidt

(10) Patent No.: US 6,190,588 B1
(45) Date of Patent: Feb. 20, 2001

(54) APPARATUS AND METHOD FOR CONTINUOUSLY PRESSING A MATERIAL PARTICLE MAT

(75) Inventor: Heinz Schmidt, Nittenau (DE)

(73) Assignee: Schlingmann GmbH & Co. (DE)

( * ) Notice: Under 35 U.S.C. 154(b), the term of this patent shall be extended for 0 days.

(21) Appl. No.: 09/311,667

(22) Filed: May 13, 1999

(30) Foreign Application Priority Data

May 15, 1998 (DE) ..... 198 21 904

(51) Int. Cl.[7] ..... B27N 3/24

(52) U.S. Cl. ..... 264/120; 264/109; 425/149; 425/371

(58) Field of Search ..... 264/109, 120; 425/371, 149

(56) References Cited

U.S. PATENT DOCUMENTS 5,762,980 * 6/1998 Bielfeldt ..... 425/371
5,788,892 * 8/1998 Graf ..... 264/120

FOREIGN PATENT DOCUMENTS 44 41 017 A1 5/1996 (DE) .

* cited by examiner

*Primary Examiner*—Mary Lynn Theisen
(74) *Attorney, Agent, or Firm*—Schnader Harrison Segal & Lewis LLP

(57) ABSTRACT

In a continuous twin-belt prepress for the production of particle board panels with pressure rollers suspended in pairs, the upper pressure rollers are suspended resiliently so that they can be pressed upwardly counter to the spring force by a catch member of a metal support screen bearing the chipboard cake when that member passes through. This prevents damage to the press and especially its forming belts as a result of increased pressure during pressing.

18 Claims, 1 Drawing Sheet

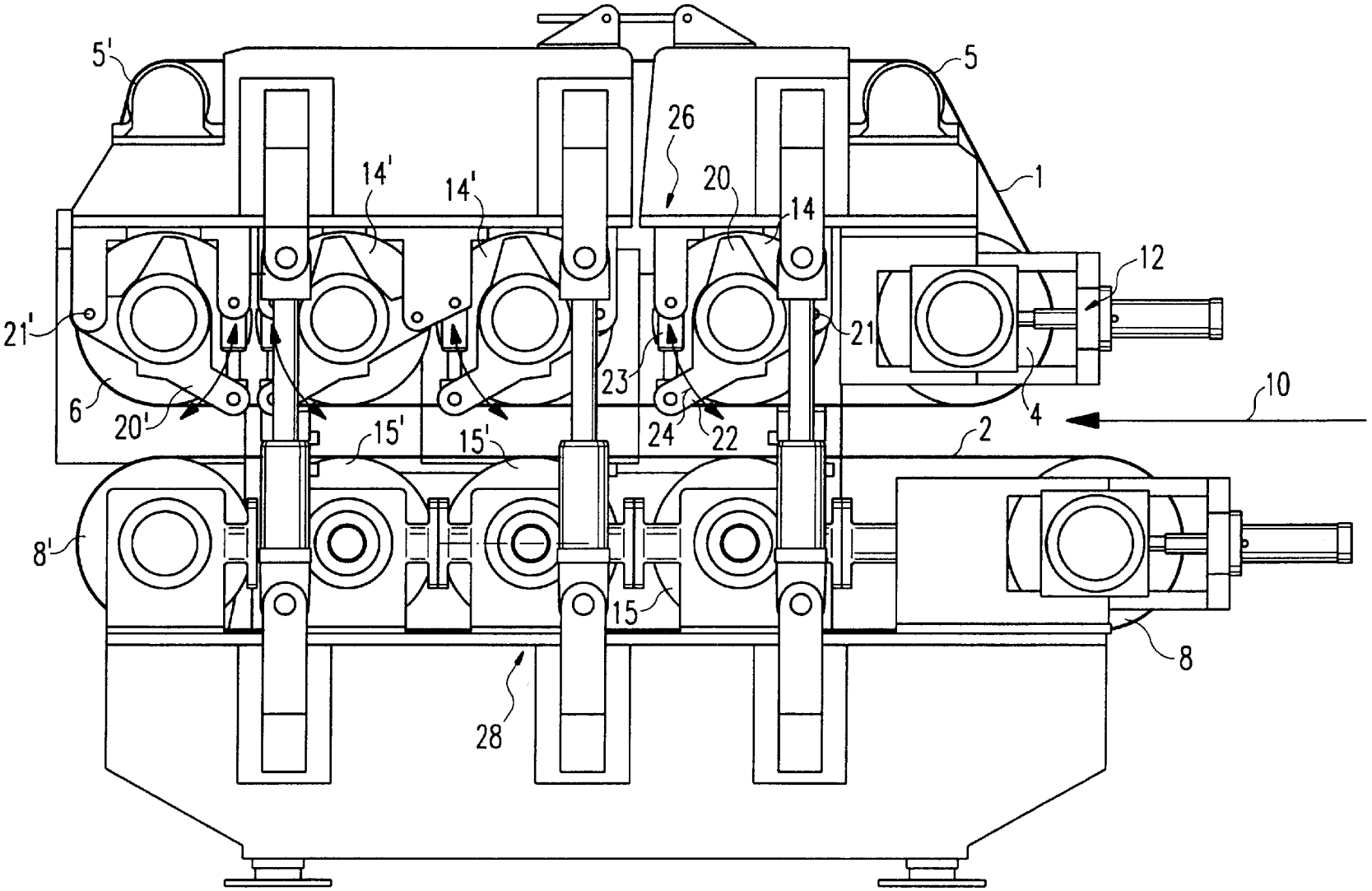
10
12
8
1
4
2
5
21
14
20
22
26
24
23
15
28
14'
15'
14'
15'
20'
5'
6
21'
8'

APPARATUS AND METHOD FOR CONTINUOUSLY PRESSING A MATERIAL PARTICLE MAT

FIELD OF THE INVENTION

This invention relates to a method of continuously pressing a material particle mat in the production of wooden material panels or the like such as particle boards (chipboards) and MDF (medium density fiber) panels, as well as a twin-belt press suitable for this purpose.

BACKGROUND

In the production of chipboard and fiber panels there is a requirement for precompression of the blanks by continuously working prepresses. Twin-belt presses in which the particle mat ("cake") of chips mixed with bonding glue deposited on a support is pulled off from the support before it enters the two forming belts of the press are known per se in the continuous production of wooden chipboard with precompression (DE 4441017 A1).

In other systems, on the other hand, known as "FLEXOPLAN" systems, the particle mat is formed by scattering the "glued chips" onto a flexible metal support screen on which they remain during precompression. At the head end of the support screen, a catch strip member is attached, 25 mm high, for example, which is engaged by chains that draw the support screen to the press. In these systems, it has not been possible to date to use a continuously working prepress because, in the passage of the catch strip member through the roller pairs and pressing segments of the known twin-belt presses, an inadmissibly high pressing pressure results and damages the forming belts and/or other parts of the press.

Systems in use to date do not allow continuous precompression of the panel material before hot pressing. Therefore, it has been necessary to provide a relatively large press plate spacing of about 25 cm, into which the chipboard cake was fed and then pressed relatively slowly, so that air can escape from the material. Precompressed panels are much thinner, so that a press plate spacing of 15 cm is sufficient and, for a press of the same height, it is possible to arrange 15 units one above the other instead of only ten with a larger plate spacing. Continuous precompression of the panel material is consequently very desirable. Not only because of the greater capacity of the hot press, but also because of the shorter pressing time since the precompressed material can also be pressed faster as a result of the smaller air content. In this way, productivity can be increased by about 50%.

OBJECT OF THE INVENTION

Accordingly, an object of the invention is to provide a method and press that enables continuous pressing, preferably precompression, without the risk of damage to the press through the presence of foreign bodies, especially the above mentioned catch of a support screen, that do not belong in the particle mat or chip cake or the like.

Other objects and advantages of the invention will become apparent to those skilled in the art and from the drawings, the detailed description and the appended claims.

SUMMARY OF THE INVENTION

In accordance with aspects of the invention, pressure rollers can be pushed away or apart by a passing catch of a support screen or other foreign bodies because of their sprung or resilient mounting and the entire pressure roller with its rotary axis is shifted or tilted and, subsequently, spring back automatically to their operating position to enable a continuous pressing operation without degradation by the foreign bodies.

At least one but preferably at least between two and four sprung pressure rollers are possible, although a much greater number may be appropriate for the purpose, e.g., up to about 20 sprung pressure rollers. As each of them is separately sprung and, therefore, individually shifted or tilted by the foreign body, the remaining other pressure rollers can during the same time stay in their normal position as necessary for the desired compression forming operation. The spring pressure of the pressure rollers can be generated hydraulically, pneumatically or also mechanically, e.g., by steel springs, and should preferably be adjustable, and/or controllable in a closed control loop as a function of setpoint values to maintain stability. In the case of a plurality of sprung pressure rollers, their spring pressure, depending on system requirements, can be the same or be set differently from one pressure roller to the next.

The spring pressure, for matching to the usually adjustable operating line pressure of the pressure rollers, can be adjustable between a minimum figure and a figure that amounts to at least about two times but, preferably, more than about five times this minimum figure. For example, the line pressure (the "punctiform" pressure applied by a roller across its width upon a surface) can be selected for normal operation depending on the required level of precompression between about 30 and about 200 kg/cm and, as the pressure rollers should not be pressed away until this nominal pressure is exceeded, the spring pressure can be set to figures corresponding to a line pressure of about 30 to about 200 kg/cm.

In the case of continuous prepresses with pressure rollers opposite one another, the upper pressure roller will preferably be sprung, while the other, i.e., the lower pressure roller, may serve as a rigid counter-pressure roller.

BRIEF DESCRIPTION OF THE DRAWING

The drawing is a schematic side elevational view of a twin-belt press according to aspects of the invention serving as a continuous prepress to produce chipboards.

DETAILED DESCRIPTION OF THE INVENTION

It will be appreciate that the following description is intended to refer to specific embodiments of the invention selected for illustration in the drawing and is not intended to define or limit the invention, other than in the appended claims.

Turning now to the Drawing, the prepress shown on a foundation has two forming belts 1 and 2, driven in a known manner not shown, of which the upper belt 1 runs over a front guide or deflection drum 4, two guide or deflection rollers 5 and 5' are arranged above and a rear guide or deflection drum 6, is positioned below the forming belt 2 and runs at the same speed through front and rear guide or deflection drums 8 and 8'. The front guide drums 4 and 8 are parallel to the working direction indicated by the arrow 10, are suspended so that they can be shifted horizontally, and have tensioners 12 attached, while the rear guide drums 6 and 8' may be suspended so that they are substantially horizontally immobile.

Vertically, the front guide drums 4 and 8 and the rear bottom guide drum 8' are suspended so that they are substantially vertically immobile (fixed).

Between the horizontal lower part of the upper forming belt 1 and the likewise horizontal upper part of the lower forming belt 2 is the pressing segment for compressing the particle mat or cake (not shown), which is deposited in a manner known per se on a flexible, metallic support screen and, on this screen, is drawn in the direction of the arrow 10 into the gap formed between the guide drums 4 and 8 and then continues through the pressing segment. The support screen (not shown) can be drawn into the prepress by chains engaging in a catch member at the front end of the screen, for example, the driving system of the prepress being synchronized with the motion of the chains.

In this example, to compress the particle cake in the pressing segment, there are three pairs of pressure rollers, these rollers being distributed at substantially uniform mutual horizontal spacings between the guide drums of the forming belts and engaging the inner side of the upper and lower forming belt to form the pressing segment. Also, the rear guide drums 6 and 8' serve to compress the cake.

The foremost pair of pressure rollers in the working direction consists of an upper, vertically sprung pressure roller 14 and a lower, rigidly mounted counter-pressure roller 15. As already explained, the pressure roller 14 is adapted to be pressed away simply resiliently transversely of the plane of the mat formed by the particle cake, i.e., upwards in this case, by a foreign body passing through the pair of rollers, especially the catch of the support screen of the particle cake, and then to spring back to its operating position. For this purpose the pressure roller 14 with its rotary axis is mounted on a rocking member 20, which in turn is rotatable at 21 about a fixed swivel axis horizontally offset from the rotary axis of the pressure roller, and on its horizontally opposite side, referred to as the rotary axis of the press, has an arm 22 by which it engages in a compression spring 23 compressible transverse to the plane of the mat, i.e., upwardly in a substantially vertical direction.

The compression spring 23 in this example can be a hydraulic or pneumatic spring on whose vertically mobile plunger the rocking member arm 22 is pivoted, while its cylinder is pivoted on the upper part 26 of the supporting construction of the press. The upward and downward swing of the entire pressure roller 14 against the force of the compression spring 23 as effected by a foreign body is indicated by the arrow 24. The spring pressure of the pressure roller is preferably regulated by a closed loop control.

The two following pairs of pressure rollers in the working direction, arranged before the rear guide drums 6 and 8', with sprung pressure rollers 14' and counter-pressure rollers 15' suspended substantially vertically rigidly in the bottom part 28 of the supporting construction of the press, correspond to the pair of rollers 14, 15.

In the example the rear guide drum 6 of the upper forming belt 1, which is horizontally aligned with the pressure rollers 14 and 14', serves as a sprung pressure roller with adjustable spring pressure and is consequently pivoted to be swiveled like pressure roller 14. The only difference is that the pivot axis 21' of the rotating shaft 20' of the guide drum 6 is on the rear side, in the working direction, of the rotary axis of the guide drum 6 that forms the sprung pressure roller. The guide drum 8' serves as a vertically rigid counter-pressure roller for the guide drum 6.

The height of the previously mentioned catch, usually between about 25 and about 40 mm, for example, results in the necessary capacity for excursion of the pressure rollers, i.e., their compliance or the amount by which the sprung pressure rollers can be pressed away counter to the spring force and transversely to the plane of the mat. This distance, limited by the compressibility of the compression spring, may be between about 10 and about 40 mm in the example described, allowing for the fact that the excursion can usually be somewhat less than the height of the foreign body. Preferably, the capacity for excursion of the pressure rollers is about 30 mm.

The two parts 26 and 28 of the supporting construction in which the guide drums 4 and 6 and the pressure rollers 14 and 14' are mounted or suspended in the top and the guide drums 8 and 8' and the counter-pressure rollers 15 and 15' in the bottom, respectively, can be moved vertically to one another for adjustment or matching to particle cakes of different thicknesses.

After leaving the prepress the precompressed panel blank is fed to another press for a main pressing operation, for example, in a conventional clock-operated box or multi-platen press or a continuous press, in which the chipboard is ready pressed by applying heat to it. The panel blank may also remain on the support screen mentioned above during the main pressing operation.

I claim:

1. A method of continuously pressing a material particle mat in which material particles are spread on a flexible support screen comprising: continuously drawing the screen with the mat upon it into a press having at least one resiliently spring mounted pressure roller to compress the mat, by means engaging a catch member of said screen; and allowing the roller to move counter to the spring force transversely to the plane of the mat upon contact of foreign bodies, said foreign bodies including said catch member, conveyed along with the mat and passing through the press with the pressure roller.

2. The method according to claim 1 wherein spring pressure of the pressure roller is adjustable and capable of being set so that the pressure roller is moved away from said mat by said foreign bodies without damage to the press when line pressure of the roller set for normal pressing operation is exceeded.

3. The method according to claim 1, further comprising at least one additional pressure roller resiliently mounted adjacent said pressure roller and pressed against the mat, wherein spring pressure of said at least one additional pressure roller is set differently from the pressure roller.

4. The method according to claim 1, wherein the press continuously precompresses the mat and a blank produced from the mat is subsequently ready pressed in a further press by application of heat.

5. A twin-belt press for continuous compression of a material particle mat deposited on a support screen comprising two forming belts running endlessly around guide drums between which a pressing segment is formed for compressing the mat continuously conveyed through the press on said support screen, and at least one pressure roller arranged on the pressing segment and forming a gap with an opposing counter-pressure roller in which the mat is compressed as it passes therethrough, said pressure roller being resiliently mounted by a spring and adapted to be moved away from the mat counter to the spring force by foreign bodies conveyed along with the mat, said foreign bodies including a catch member of the support screen.

6. The press according to claim 5, wherein the rotatable counter-pressure roller is mounted with said sprung pressure roller with an adjustable spacing between them in a common supporting construction.

7. The press according to claim 6, wherein the counter-pressure roller is rigidly mounted.

8. The press according to claim 5, wherein at least two sprung pressure rollers are arranged one after the other in the direction in which the mat is conveyed.

9. The press according to claim 5, wherein the spring pressure of the pressure roller is adjustable.

10. The press according to claim 5, wherein the spring pressure of the pressure roller is regulated by a closed loop control.

11. The press according to claim 5, wherein the spring pressure for matching to the adjustable operating line pressure of the pressure roller is adjustable between a minimum value and a second value that is at least about two times the minimum value.

12. The press according to claim 11, wherein said second value is more than about five times the minimum value.

13. The press according to claim 5, wherein said pressure roller is rotatable an a rocking member that is adapted to be moved away from the mat counter to the force of a spring engaging the pressure roller.

14. The press according to claim 5, wherein the spring engaging the pressure roller is a hydraulic or pneumatic spring.

15. The press according to claim 5, wherein the pressure roller is subjected mechanically to the force of a metallic spring.

16. The press according to claim 5, wherein at least one of the guide drums of a forming belt of the press is a sprung pressure roller for compressing the mat, said sprung pressure roller being adapted to be moved away from the mat counter to adjustable spring force applied to said sprung pressure roller.

17. The press according to claim 5, wherein the sprung pressure roller is adapted to be pressed away transversely to the plane of the mat counter to the spring force by at least about 10 mm.

18. The press according to claim 17, wherein said roller is adapted to be pressed away by not more than about 40 mm.

* * * * *